United States Patent [19]

Alarcon

[11] Patent Number: 5,048,851

[45] Date of Patent: Sep. 17, 1991

[54] PORTABLE VEHICLE APPARATUS

[76] Inventor: David Alarcon, RR1 2830 Bonitz, La Luz, N. Mex. 88337

[21] Appl. No.: 574,882

[22] Filed: Aug. 30, 1990

[51] Int. Cl.[5] ..... B62M 1/00

[52] U.S. Cl. ..... 280/87.042; 280/11.23; 280/11.26

[58] Field of Search ..... 280/11.3, 11.19, 11.22, 280/11.23, 11.26, 87.05, 87.042, 87.041, 842, 843; 272/70, 114, 117, 119, 122, 123; 224/266, 267, 219, 222

[56] References Cited

U.S. PATENT DOCUMENTS

| | | | |
|---|---|---|---|
| 1,801,230 | 4/1931 | Fehre | 280/11.23 |
| 1,996,671 | 4/1935 | Busby | 280/11.23 |
| 3,365,208 | 1/1968 | Blanchard | 280/842 |
| 3,389,922 | 6/1968 | Eastin | 280/11.23 |
| 3,749,413 | 7/1973 | Nicolson | 280/842 |
| 3,767,220 | 10/1973 | Peterson | 280/842 |
| 4,150,838 | 4/1979 | Lappage | 280/843 |
| 4,189,164 | 2/1980 | Moorer | 280/87.05 |
| 4,363,492 | 12/1982 | Eriksson | 280/842 |
| 4,468,045 | 8/1984 | Sarazen | 280/11.3 |

*Primary Examiner*—David M. Mitchell
*Assistant Examiner*—Martin Gerich
*Attorney, Agent, or Firm*—Leon Gilden

[57] ABSTRACT

An apparatus for use particularly by joggers to prevent unnecessary impacting to a jogger's knees during a downhill traverse in a jogging event. The apparatus is defined as a plurality of "U" shaped framework members arranged for interfitting relative to one another. The framework members are each separable to accommodate positioning about an individual's anatomy and are securable to the anatomy during periods of transport by a plurality of fabric straps securable together by hook and loop fasteners. An inflatable bladder is positioned adjacent each base of each respective "U" shaped framework to resiliently accommodate and cushion mounting to a torso or arm portion of an anatomy of an individual jogger during their transport prior to use.

1 Claim, 5 Drawing Sheets

PRIOR ART

PORTABLE VEHICLE APPARATUS

BACKGROUND OF THE INVENTION

1. Field of the Invention

The field of invention relates to vehicle apparatus, and more particularly pertains to a new and improved portable vehicle apparatus for use particularly by joggers and long distance runners to permit effective use of the organization in a downhill running scenario.

2. Description of the Prior Art

The use of various portable vehicles for skate boarding and the like is well known in the prior art. Such vehicles combine ease of mounting and light-weight for use, but are frequently of an elaborate platform construction to require their manual support and grasping during periods of non-use, as opposed to the instant invention. Such prior art structure is exemplified in U.S. Pat. No. 3,365,208 to Blanchard setting forth a plurality of spaced platforms for mounting to shoe portions of an individual, wherein the platforms include forward and rear wheels at each end thereof.

U.S. Pat. No. 3,767,220 to Peterson sets forth the use of a platform including upwardly oriented end portions to rotatably mount wheel structure for permitting an individual to mount the platform and descend a downhill traverse.

U.S. Pat. No. 3,389,922 to Eastin sets forth a vehicular device with a platform mounting forward and rear spaced wheels, with the platform of a unitary construction, as is typical of the prior art.

U.S. Pat. No. 3,749,413 to Nicolson sets forth a ski simulation device wherein a unitary platform mounts wheel structure at each end thereof for practice skiing during periods devoid of snow cover.

U.S. Pat. No. 4,363,492 to Eriksson sets forth a further practice ski structure utilizing spaced unitary frameworks for securement of each foot of an individual, with wheels mounted at each end of each framework for simulation of cross country skiing.

As such, it may be appreciated that there continues to be a need for a new and improved portable vehicle apparatus wherein the same addresses both the problems of ease of use as well as effectiveness in construction and in this respect, the present invention substantially fulfills this need.

SUMMARY OF THE INVENTION

In view of the foregoing disadvantages inherent in the known types of portable vehicle construction now present in the prior art, the present invention provides a portable vehicle apparatus wherein the same permits transport and mounting a torso portion of an individual during periods of non-use. As such, the general purpose of the present invention, which will be described subsequently in greater detail, is to provide a new and improved portable vehicle apparatus which has all the advantages of the prior art vehicle apparatus and none of the disadvantages.

To attain this, the present invention provides an apparatus for use particularly by joggers to prevent unnecessary impacting to a jogger's knees during a downhill traverse in a jogging event. The apparatus is defined as a plurality of "U" shaped framework members arranged for inter-fitting relative to one another. The framework members are each separable to accommodate positioning about an individual's anatomy and are securable to the anatomy during periods of transport by a plurality of fabric straps securable together by hook and loop fasteners. An inflatable bladder is positioned adjacent each base of each respective "U" shaped framework to resilintly accommodate and cushion mounting to a torso or arm portion of an anatomy of an individual jogger during their transport prior to use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable vehicle apparatus which has all the advantages of the prior art vehicle apparatus and none of the disadvantages.

It is another object of the present invention to provide a new and improved portable vehicle apparatus which may be easily and efficiently manufactured and marketed.

It is a further object of the present invention to provide a new and improved portable vehicle apparatus which is of a durable and reliable construction.

An even further object of the present invention is to provide a new and improved portable vehicle apparatus which is susceptible of a low cost of manufacture with regard to both materials and labor, and which accordingly is then susceptible of low prices of sale to the consuming public, thereby making such portable vehicle apparatus economically available to the buying public.

Still yet another object of the present invention is to provide a new and improved portable vehicle apparatus which provides in the apparatuses and methods of the prior art some of the advantages thereof, while simultaneously overcoming some of the disadvantages normally associated therewith.

Still another object of the present invention is to provide a new and improved portable vehicle apparatus wherein the same permits ease of securement to an individual by disassemblage of the vehicle and mounting to torso portions of an individual for transport thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
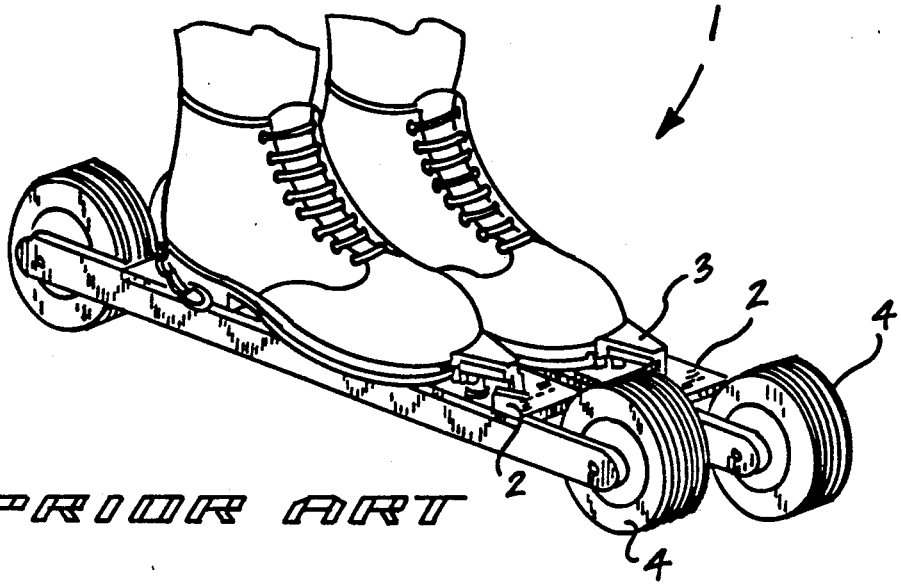
FIG. 1 is an isometric illustration of a prior art portable vehicle organization.

With reference now to the drawings, and in particular to FIGS. 1 to 12 thereof, a new and improved portable vehicle apparatus embodying the principles and concepts of the present invention and generally designated by the reference numerals 10 and 10*a* will be described.

Figure 2:
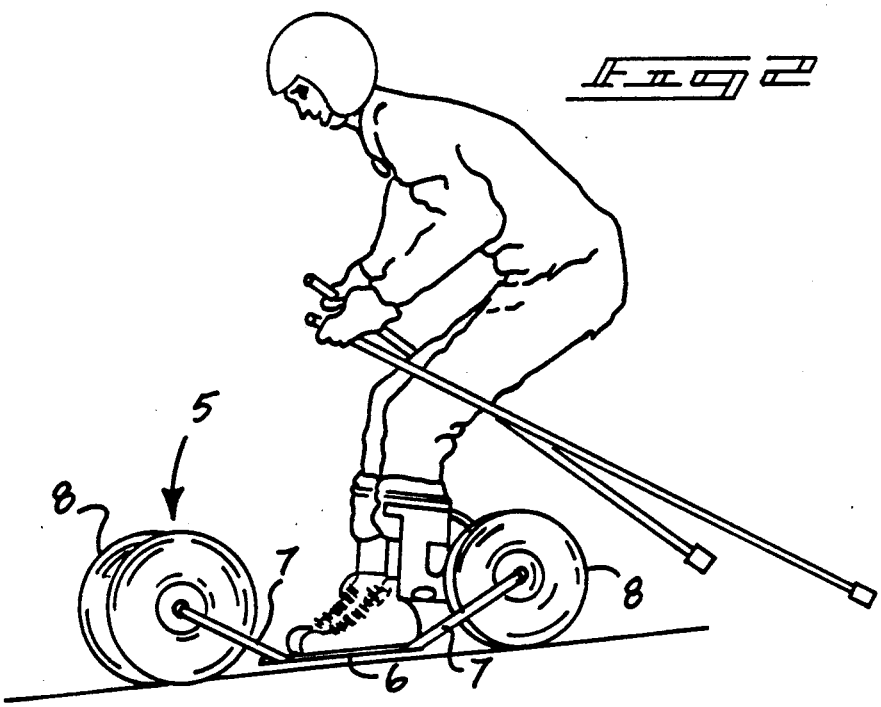
PRIOR ART Fig 2
FIG. 2 is an isometric illustration of a further prior art portable vehicle construction.

FIG. 1 illustrates a prior art portable vehicle structure as exemplified in U.S. Pat. No. 3,365,208, wherein a plurality of platforms 2 include forward and rear wheels 4, and securement structure to mount the platform to shoe portions of an individual. FIG. 2 illustrates a further prior art vehicle structure 5, wherein a central platform 6 includes leg portions 7 extending upwardly therefrom to mount a forward and rear wheel 8 relative to the platform, as illustrated in U.S. Pat. No. 3,767,220. Typically of the prior art, the platforms are of a unitary construction for use by individuals.

Figure 3:
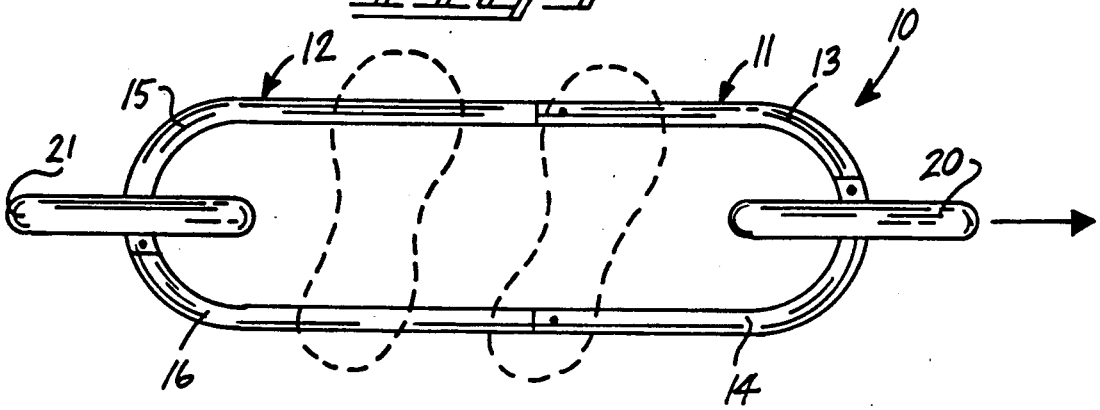
FIG. 3 is an orthographic top view of the instant invention.
Figure 4:
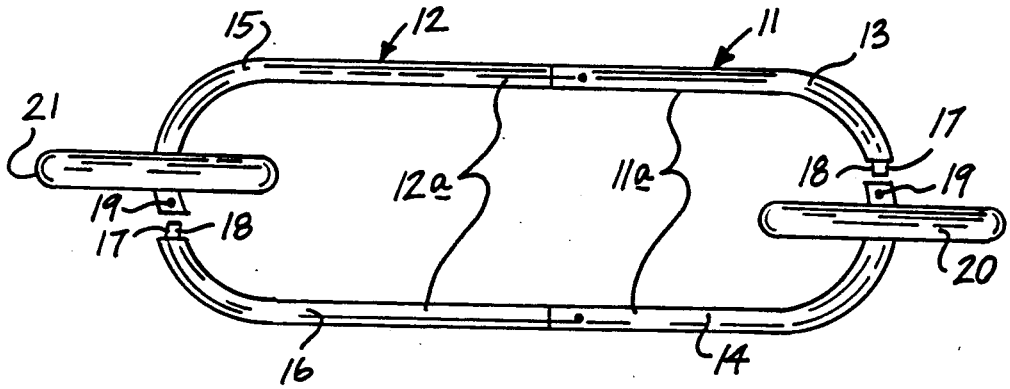
FIG. 4 is an orthographic top view of the instant invention in a partially disassembled configuration.
Figure 5:
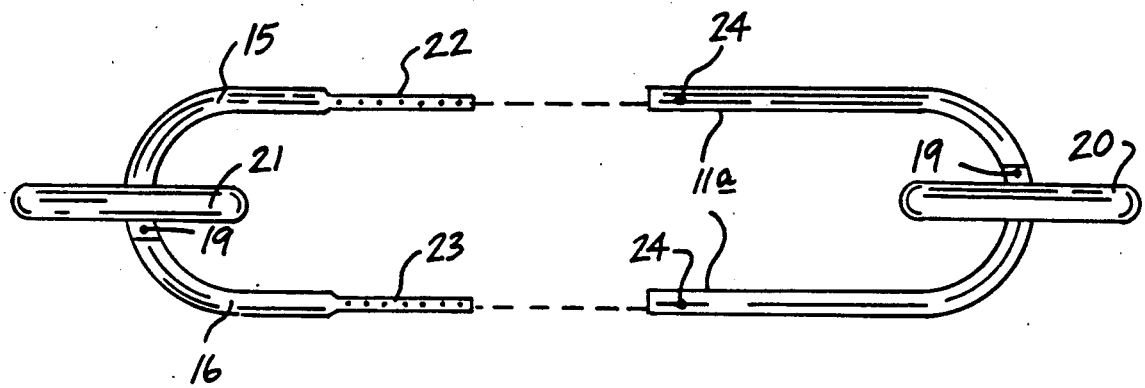
FIG. 5 is an orthographic top view of the instant invention illustrating a further disassembled orientation of the structure of the instant invention.
Figure 6:
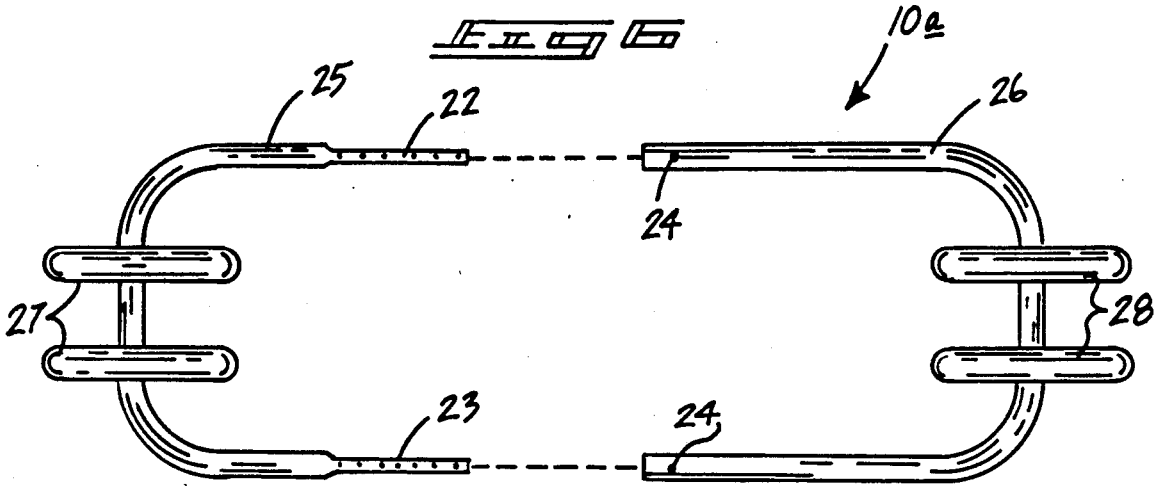
FIG. 6 is an orthographic top view of a modification of the instant invention.
Figure 10:
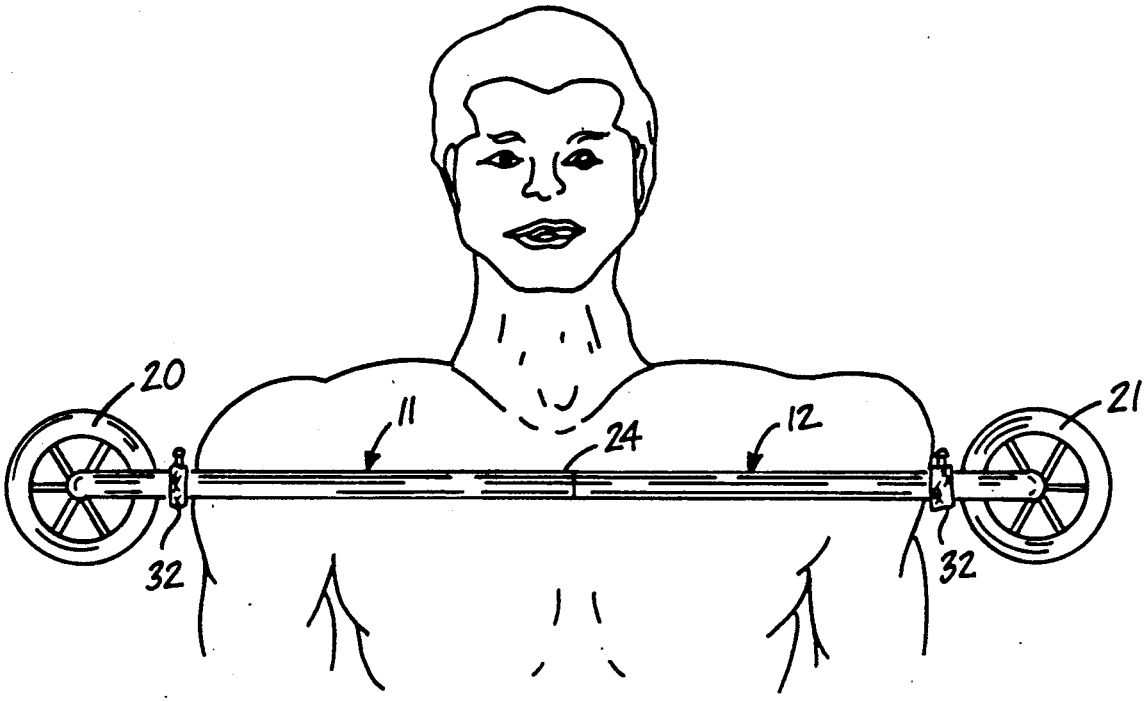
FIG. 10 is an orthographic frontal view, taken in elevation, of an individual mounting the organization about the shoulder portion of the individual's torso.

More specifically, the portable vehicle apparatus 10 of the instant invention essentially comprises a first "U" shaped frame 11 selectively securable to a second "U" shaped frame 12. The first and second "U" shaped frames 11 and 12 define respective first and second parallel legs 11*a* and 12*a* of each "U" shaped frame. The first "U" shaped frame 11 includes a first "J" shaped leg 13 securable to a second "J" shaped leg 14 to define the first "U" shaped frame. The second "U" shaped frame 12 includes a third "J" shaped leg 15 securable to a fourth "J" shaped leg 16. The first and fourth "J" shaped legs each include a boss plug 17 extending outwardly from a forward terminal end of each "J" shaped leg, with a boss plug bore 18 directed orthogonally through each boss plug. The boss plug bore 18 cooperates with a first connector pin 19 mounted through an adjacent free end of the second and third "J" shaped legs to secure the first and second "J" shaped legs together and the third and fourth "J" shaped legs together to define each respective "U" shaped frame. The first and second "U" shaped frames 11 and 12 are separable as illustrated in FIG. 4 to permit mounting about a torso portion of an individual, as illustrated in FIG. 10 for example. Further, when the apparatus 10 is in an assembled configuration, as illustrated in FIG. 3, an individual straddles the first and second assembled "U" shaped frames 11 and 12, as illustrated, for transport in a downhill traverse.

The third and fourth "J" shaped legs of the second "U" shaped frame 12 include a respective first and second apertured leg extension 22 and 23. Each apertured leg extension 22 and 23 is complementarily receivable within each respective leg 11*a* of the first "U" shaped frame and is secured therewithin by a second connector pin 24 directed through one of the apertures of the apertured legs 22 and 23. A first wheel 20 and a second wheel 21 are mounted medially of each respective first and second "U" shaped frame 11 and 12 and in coplanar alignment relative to one another, as illustrated.

As a variation, a plurality of first and second wheel pairs 27 and 28 may be mounted to a modified first and second "U" shaped frame 25 and 26 to effect greater stability if required by an individual.

Figure 7:
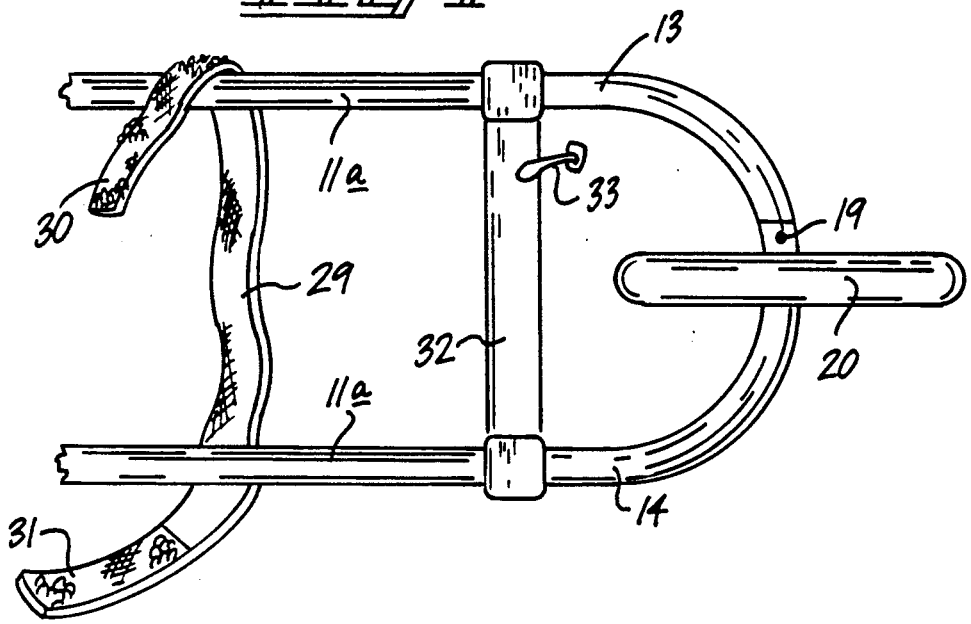
FIG. 7 is a top orthographic view illustrating securement strap structure utilized by the instant invention.
Figure 8:
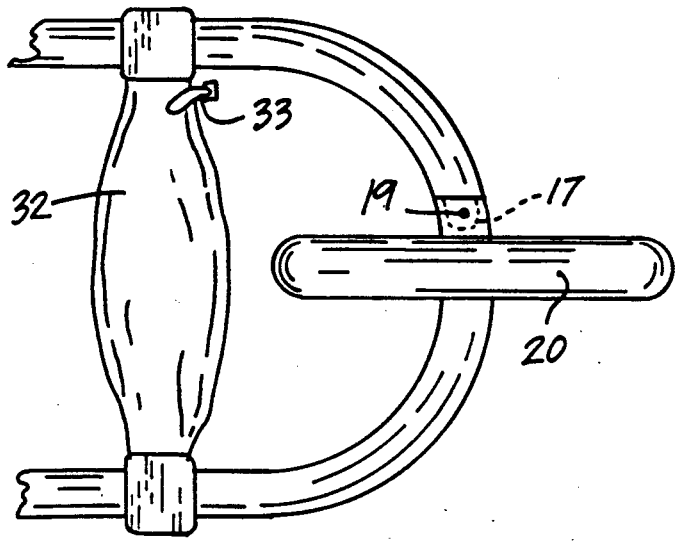
FIG. 8 is an orthographic top view of the instant invention illustrating a typical framework member of the instant invention with an inflatable bladder mounted thereon.
Figure 9:
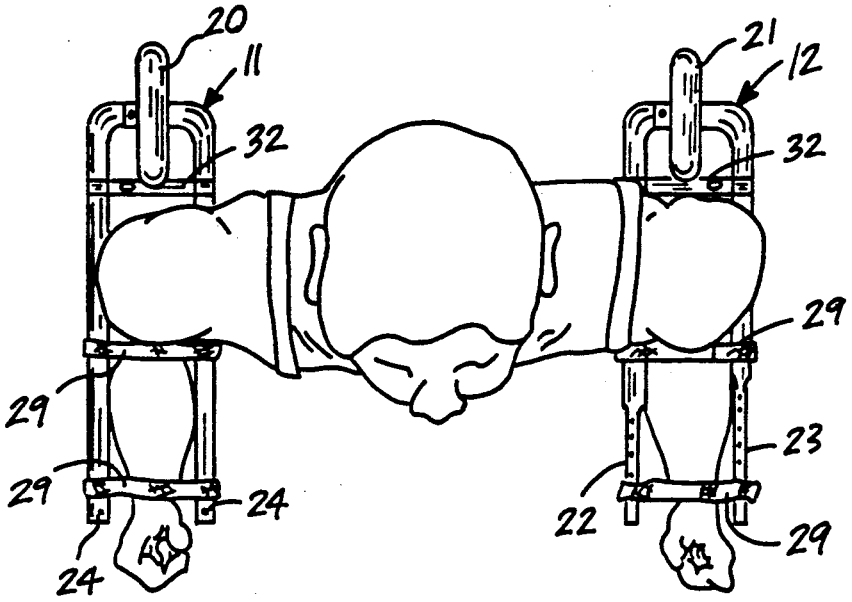
FIG. 9 is an orthographic top view of the instant invention secured to an individual about the individual's forearm portions.
Figure 11:
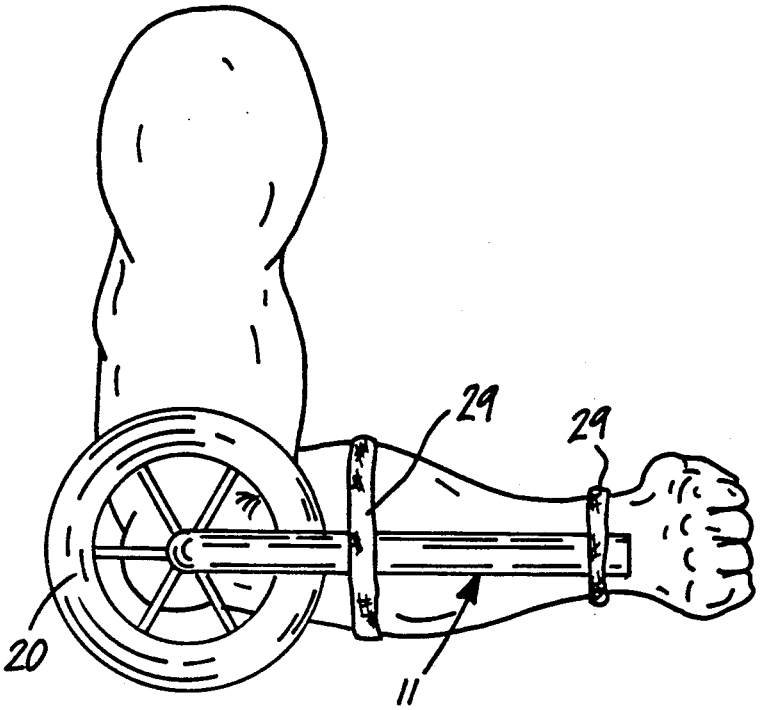
FIG. 11 is an orthographic side view of the mounting of a framework member of the instant invention to a forearm portion of an individual.
Figure 12:
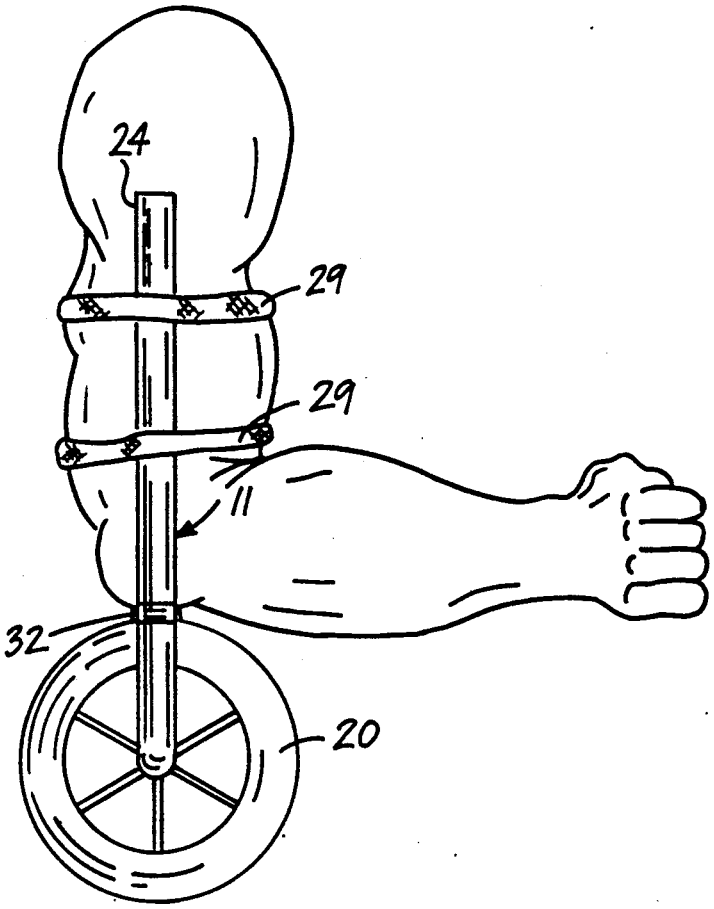
FIG. 12 is an orthographic side view, taken in elevation, in mounting of the framework to an upper portion of an individual.

Each "U" shaped frame includes at least one, and typically a plurality of, fabric belt members 29, with each fabric belt member 29 including a first and second hook and loop fastener patch 30 and 31 respectively mounted to each terminal end of each fabric belt member 29 to permit mounting of the "U" shaped frame to arm portions of an individual, as illustrated in FIGS. 9, 11, and 12. The fabric belt members may be, if desired, fixedly secured to span the opposed parallel first and second legs 11*a* and 12*a*, as illustrated in FIGS. 7 and 9 for example. An inflatable bladder 32 is positioned medially between a respective wheel and a fabric belt member 29, with each inflatable bladder 32 including an inflation valve 33 to permit inflation of each bladder 32. The bladder 32 when inflated accommodates repositioning and movement of an individual's arm when secured within each framework, and effects secure and comfortable mounting of each framework to an individual.

Further, the "U" shaped frames when disassembled may be mounted to an individual's leg or waist portion in a manner most conveniently suited to each individual's physical configuration.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable vehicle apparatus comprising, a longitudinally aligned elongate loop, the loop including a first "U" shaped frame selectively securable to a second "U" shaped frame, the first "U" shaped frame including a first wheel rotatably mounted to the first "U" shaped frame medially thereof, and the second "U" shaped frame including a second wheel rotatably mounted to the second "U" shaped frame medially thereof, with the first and second wheels aligned in a single plane, and wherein the first "U" shaped frame includes a first "J" shaped leg and a second "J" shaped leg, the first "J" shaped leg securable the second "J" shaped leg, the first "J" shaped leg including a boss plug receivable within the second "J" shaped leg, with the boss plug including a boss plug bore, and the second "J" shaped leg including a first connector pin to secure the second "J" shaped leg to the first "J" shaped leg, and the second "U" shaped frame including a third "J" shaped leg and a fourth "J" shaped leg, the fourth "J" shaped leg including a further boss plug, with the further boss plug including a further boss plug bore, the further boss plug bore receivable within the third "J" shaped leg and the third "J" shaped leg including a further first connector pin to secure the third "J" shaped leg to the fourth "J" shaped leg, and wherein the first and second "J" shaped legs of the first "U" shaped frame includes spaced parallel first end legs, and the third and fourth "J" shaped legs of the second "U" shaped frame includes spaced parallel second end legs, the spaced parallel second end legs complementarily and telescopingly receivable within the first end legs, and wherein the second end legs each include apertures equally spaced therealong, and the first end legs each include a second connector pin directed through the first end legs to secure the second end legs within the first end legs, and wherein each of the first end legs include a plurality of first fabric belt members orthogonally mounted across the first legs, and the second end legs include a further plurality of fabric belt members orthogonally mounted at spaced intervals along the second end legs, and the fabric belt members each include cooperative hook and loop fastener patches to secure the fabric belt members together, and wherein the first "U" shaped frame includes a first inflatable bladder and the second "U" shaped frame includes a second inflatable bladder, the first inflatable bladder mounted between the first wheel and an adjacent fabric belt member, and the second inflatable bladder positioned between the second wheel and an adjacent fabric belt member of the second "U" shaped frame, and each inflatable bladder includes an inflation valve to effect selective inflation of each inflatable bladder.

* * * * *